United States Patent [19]

Hartley

[11] Patent Number: 4,840,295

[45] Date of Patent: Jun. 20, 1989

[54] ROTARY POURING NOZZLE FOR A VESSEL FOR HOLDING MOLTEN METAL

[75] Inventor: James F. M. Hartley, Cardiff, United Kingdom

[73] Assignee: Foseco International Limited, Birmingham, England

[21] Appl. No.: 246,313

[22] Filed: Sep. 19, 1988

[30] Foreign Application Priority Data

Oct. 1, 1987 [GB] United Kingdom ..... 8723059

[51] Int. Cl.[4] ..... B22D 37/00

[52] U.S. Cl. ..... 222/598; 266/236

[58] Field of Search ..... 222/598, 601, 603; 266/236

[56] References Cited

U.S. PATENT DOCUMENTS

| | | | |
|---|---|---|---|
| 2,698,630 | 1/1955 | McShurley et al. | 222/598 |
| 3,651,998 | 3/1972 | Rocher | 222/598 |
| 3,685,706 | 8/1972 | Fehling | 222/598 |
| 3,760,992 | 9/1973 | Bieri | 222/598 |
| 4,200,210 | 4/1980 | Riegler et al. | 222/598 |

FOREIGN PATENT DOCUMENTS 1276625 6/1972 United Kingdom .

*Primary Examiner*—Robert McDowell

*Attorney, Agent, or Firm*—Nixon & Vanderhye

[57] ABSTRACT

A rotary pouring nozzle comprising a stationary component having a rotatable component sealingly engaged in it for rotation relative to the stationary component, has an interlocking connection between the components inside the stationary component which retains them in their working relationship. The stationary component has a flow aperture or apertures directed laterally of the rotational axis of the rotatable component with which a nozzle outlet in the rotatable component can be moved into and out of register by rotation of the rotatable component. In one embodiment an enlarged portion of the rotatable component trapped in a complementary recessed portion of the interior of the stationary component provides the interlocked connection, and inert gas supplied by way of gas permeable ring in the stationary component provides lubrication between the components. The stationary component may have non-circular locating engagement with the vessel to which the nozzle is fitted.

13 Claims, 5 Drawing Sheets

ROTARY POURING NOZZLE FOR A VESSEL FOR HOLDING MOLTEN METAL

Figure 1:
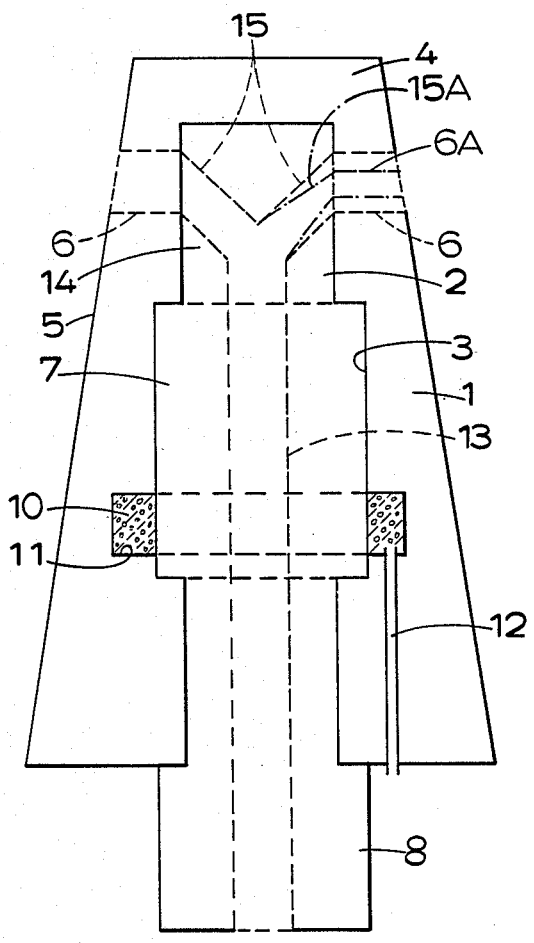

This invention relates to a rotary pouring nozzle for a vessel, such as a ladle or tundish, for holding molten metal.

Rotary pouring nozzles generally comprise an assembly of a stationary component which sealingly secures in an opening in the bottom of a vessel for holding molten metal, and a rotatable component which is rotatably mounted in sealing engagement with the stationary component, the components being provided respectively with a flow aperture and a pouring outlet which by rotation of the rotatable component can be brought into register for molten metal to be poured from the vessel, and moved out of register to stop flow from the vessel. The rotatable component is usually operated from the underside of the vessel.

In one known rotary pouring nozzle, the subject of British Patent Specification No. 1 276 625, the stationary component is disc-shaped and is located in sealing engagement with an upper end face of a cylindrical rotatable component co-axial with the stationary component. The stationary component is fixed to, and the rotatable component is rotatable in an axial bore of, a frusto-conical brick wedged in an opening in the bottom of the vessel and held by a retaining plate retained to the underside of the vessel by bolts, keys or clamps. A thrust plate secured by tension bolts to the retaining plate urges the upper end face of the rotatable component into sealing, sliding, contact with the under face of the stationary component. There is an eccentrically positioned flow aperture in the stationary component, and a pouring outlet, which extends through the rotatable component, opens co-axially through the bottom of the component but is cranked within the component so that its upper end is off-set from the rotational axis of the rotatable component. By turning the rotatable component the upper end of the pouring outlet can be moved into and out of register with the flow aperture.

With this known rotary pouring nozzle, accuracy of the wedging of the usually heavy frusto-conical brick in the bottom of the vessel is difficult to achieve but is critical to the correct performance of the nozzle. Misalignment of the brick could lead to a non-vertical pouring stream of metal from the vessel and/or leakage of metal at the connection. Entry into a hot vessel to make corrective jointing between the brick and the refractory lining of the vessel, if there has been misalignment, is impractical, and considerable time can be wasted waiting for the vessel to cool sufficiently for the jointing to be done. Furthermore, if there should be any parting of the slidingly engaged surfaces of the stationary and rotatable components, for example caused by flexing of the thrust plate, a breakdown of the assembly could occur. In addition, because the stationary component is confined between a retaining collar portion of the upper end of the brick, inside the vessel, and the rotatable component, if either the collar or the stationary component should become damaged metal could seep from the vessel. Wear and damage are likely to occur in the course of removing residual solid metal (skulls) from inside the vessel, and as a result of slag attack and solution/erosion of the brick due to molten metal forming a vortex above the nozzle, which the upwardly-directed flow aperture in the stationary component will induce.

It is also known from U.S. Pat. No. 3,651,998 to provide a rotary pouring nozzle having an annular stationary component with a closed top and a plurality of spaced flow apertures in its circumferential wall communicating with the central passageway in which a rotatable component is located. The rotatable component is tubular having an open-ended central through-passage and a plurality of spaced channels opening through its circumferential wall into the through-passage. By rotation of the rotatable component the channels can be moved into and out of register with the flow apertures of the stationary component respectively to allow and stop metal flow through the nozzle. The rotatable component is retained in the stationary component by an annular plate secured to the underside of the stationary component in overlapping engagement with the bottom end of the rotatable component around the outlet end of the through-passage. Springs acting between the annular plate and the rotatable component urge the latter upwards into bearing contact at its upper end with the closed top of the stationary component which closes off the top end of the through-passage. The rotatable component is rotated by means of a lever threadably attached at an inner end radially to the rotatable component and projecting out through a slot in the circumferential wall of the stationary component for operation, the slot permitting sufficient angular movement of the lever and rotatable component to move the channels into and out of register with the flow apertures.

In this construction just described the correct securing of the annular plate and tensioning of the springs is relied upon to retain the rotatable component securely in the stationary component and in a proper operational relationship with the stationary component. This includes holding the top of the rotatable component in bearing contact with the closed top of the stationary member in order to seal off the top of the through-passage and prevent seepage of metal out of the top of the through-passage and between the interfaces of the two components. Since the springs are close to the through-passage they are inevitably subject to substantial thermal change which can cause the tensions of the springs to vary, thereby making it difficult to maintain an effective seal. Break-down of the springs under the high temperatures to which they are subjected is also likely. Prevention of metal penetration between the interfaces is essential. If penetration should occur the effectiveness of the nozzle would be reduced and turning of the rotatable component would be more difficult and may be prevented altogether by the metal when it solidifies. The spring- urged bearing contact of the top of the rotatable component with the closed top necessarily increases the friction between the two components which increases the effort required to be applied to the lever for turning the rotatable component.

A further disadvantage is that the slot in the stationary component for the lever introduces a potential point of weakness into that component. It is desirable, therefore, for the slot to be short to reduce its weakening effect on the stationary components, and that restricts the range of rotary movement available for the rotatable component. Furthermore the attachment of the lever at a threaded hole in the rotatable component which concentrates the torque on the component at that single point when the lever is turned introduces a shear stress in the rotatable component which, being of a refractory material, is liable to fail at the high operating temperatures of the nozzle.

According to the present invention there is provided a rotary pouring nozzle for a vessel for holding molten metal, comprising a stationary component and a rotatable component sealingly engaged rotatably in said stationary component for rotation relative to said stationary component about a rotational axis fixed with respect to said stationary component, said stationary and rotatable components having interlocking parts inside said stationary component which retain said components together in their working relationships, said stationary component having a flow aperture directed laterally of said rotational axis, and said rotatable component having a nozzle outlet movable into and out of communicating register with said flow aperture by rotation of said rotatable component relative to said stationary component.

A first one of the components may be formed, and the second component may be formed subsequently in situ with respect to the first component. It is desirable that the interlocking connection between the two components should resist relative movement between them other than the required rotational movement of the rotatable component. The rotatable component may have an enlarged portion which is journalled and trapped within a complementary recessed portion of the stationary component to restrain the rotatable component from movement longitudinally of its rotational axis. Alternatively the rotatable component may have a recessed portion or portions into which one or more portions of, or parts retained in, the stationary component project to interlock the components.

Interlocking the components facilitates the fitting of the nozzle. Since the rotatable component is already located with respect to the stationary component ready for service, the fitter has only to concern himself with the location and securing of the stationary component on the vessel.

The stationary component may be upwardly tapered externally and be located in a complementally tapered opening in the vessel, being inserted in the opening from the outside of the vessel. It may be bolted, clamped or otherwise suitably secured rigidly to the exterior. The component may alternatively be arranged to be located in the opening in the vessel from the inside of the vessel. As an aid to location of the stationary component in the vessel, the component may have an oval or other non-circular external circumferential shape to engage in an opening of corresponding shape in the vessel. An oval shape is preferred because then the pouring nozzle can only be located in either one of two alternative positions which facilitates indexing of the rotatable component between registering and non-registering of the nozzle outlet with the flow aperture or apertures.

A gas-permeable ring may be located between the two components which provides for gas-film lubrication to prevent the rotatable component from binding in the stationary component. Such a ring releases pressurised gas, normally an inert gas such as argon, between the interfaces of the components to provide the lubrication. The gas pressurisation between the interfaces may also assist in providing resistance to ingress of metal from the vessel between the components. Such a ring is also desirable when, as is useful in the casting of high aluminium content steels, inert gas may be fed to the metal stream as it flows through the nozzle to prevent, or delay, the onset of alumina depositions, which may ultimately block the nozzle.

As a further, or alternative, means of providing lubrication between the components, a lubricant material, such as finely powdered graphite, may be applied, between the interfaces. The lubricant material may be applied to the interfaces in the course of manufacture or assembly of the nozzle, or it may be applied, for example by pumping it under pressure, and possibly in combination with an inert gas, during use of the nozzle.

Preferably the rotatable component is closed above the level of the flow aperture or apertures so that metal having entered the nozzle outlet cannot find its way to the interfaces of the components and give rise to binding of the rotatable component.

The stationary and rotatable components may be made of refractory materials which may be the same or dissimilar. Suitable binding systems such as are well known in the ceramic industry may be combined with the refractory materials to provide ceramic bonding of the material when fired at high temperature. The minimum required firing temperature of the components may vary with the refractory and binding system used but it is desirable always for it to be above the maximum potential operational temperature of the nozzle in use.

The components may be formed in various ways. For example, they may be cast or moulded, or be pressure formed, as for example by linear or isostatic pressure forming, and the two components may be formed by the same or different methods. It may be convenient in some embodiments of the invention, for example, for the rotatable component to be made of a high density refractory material by pressure forming, and for the stationary component to be made of a castable or mouldable refractory material.

The one component may be formed into or around the other component, as the case may be. There are known methods suitable for forming the one component from a refractory material in a manner which will permit free relative rotation between the interconnected components. In a method which makes use of the feature of castable or mouldable refractory materials that they shrink slightly upon firing, one of the components is cast or moulded first and fired at a lower temperature than that required subsequently for the assembled nozzle, the temperature being high enough to give only reversible linear thermal expansion so that no hysteresis occurs. A suitable parting agent, which may be a parting compound, a varnish or a separate membrane, is applied to the fired component. Varnish, which is lost in the full firing of the assembled components, produces smooth contact surfaces on the components which is essential for free rotation of the rotatable component in the stationary component. The other component is then cast or moulded inside or around the fired component, as the case may be, and the assembly is fired at a higher temperature which results in permanent linear shrinkage of both components and maintains a clearance between them which leaves the rotatable component able to rotate freely in the stationary component. A diamond or other suitable grinding paste may be used to assist in securing a good fit between the components.

A wide variety of refractory materials is available for optimisation of the performance of the components, as castable, mouldable or high-fired, pre-formed items, and with or without pitch impregnation. By way of example, among the refractory materials which may be used are alumina, mullite, corundum, andalusite, calcined magnesite (MgO), zircon, zirconia, fused silica, graphitised alumina, refractory silicates, silicon carbide, silicon nitride and boron nitride. These may be used alone or as mixtures. In the method described above in which, for example, an ethyl-silicate-bonded mullite refractory system is used the component which is cast or moulded first is subjected to an initial firing temperature in the range 900°-1100° C., say 1000° C., and when the other component has been cast or moulded the assembly is fired at the higher temperature in the range 1550°-1750° C., say 1650° C.

More than one flow aperture may be provided in the stationary component for registering with the nozzle outlet. The flow apertures may be of differing cross-sectional sizes and be selectively registered with the nozzle by rotation of the rotatable component. For example, there may a larger, starting, aperture for initial pouring from the nozzle, and one or more running apertures which can be brought into use for subsequent stages of pouring. This facility can provide a more reliable start in a casting operation. In a continuous casting process the larger starting aperture may be used to assist rapid filling of a tundish to its working level so as to minimise heat loss. Similar variability may be achieved by providing the nozzle outlet with two or more feeder entries of differing cross-sectional sizes which may be selectively registered with one or more flow apertures in the stationary component.

As the or each flow aperture is directed laterally of the rotational axis of the rotatable component the likelihood is reduced of a vortex being formed in the metal in the vessel to which the nozzle is applied. The likelihood is further reduced by having the flow apertures in one or more pairs, the apertures of the or each pair being radially opposed about the rotational axis of the rotatable component and being simultaneously registrable with a pair of feeder entries of the nozzle outlet, so that metal can flow into the nozzle from opposite directions.

The rotatable component may be adapted to be rotated manually, or it may have associated power-driven means for rotating it between operative and inoperative positions. Preferably for either manner of rotation the rotatable component projects at one end from the stationary component and an annular drive transmitting element or part is engaged about that projecting end, for example with a non-circular or keyed interconnection, such that the torque on the rotatable component from the driving forces is distributed around the rotational axis of the component and risk of fracture of the component is thereby considerably reduced. Power-driven means for rotating the rotatable component may be adapted for automatic control of pouring from the vessel to which the nozzle is applied. For continuous casting power-driven means may be controlled, for example, by signals from a mould-level device or other sensor, or sensors, so that pouring from the vessel can be automatically started and stopped.

Figure 2:
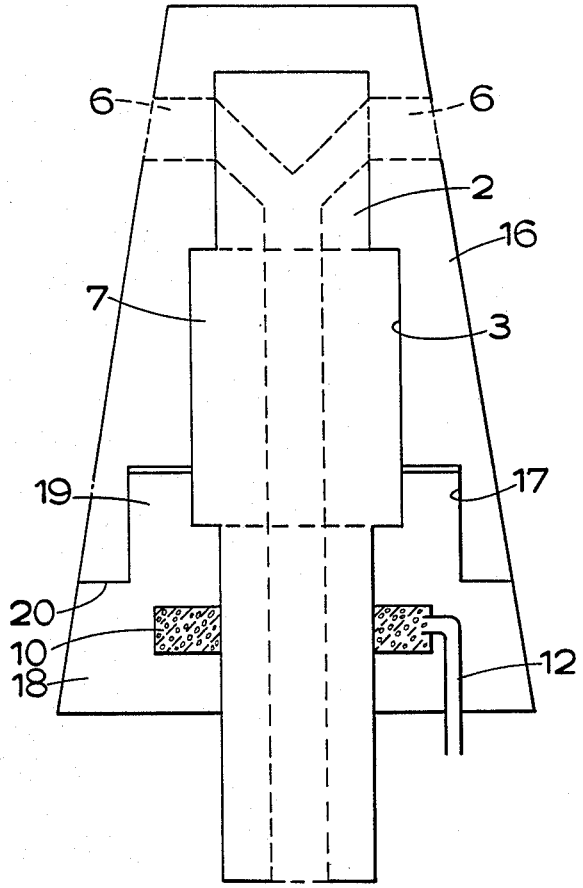
Figure 3:
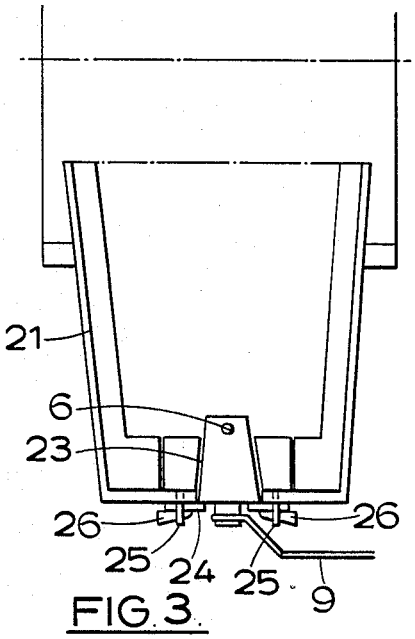
Figure 4:
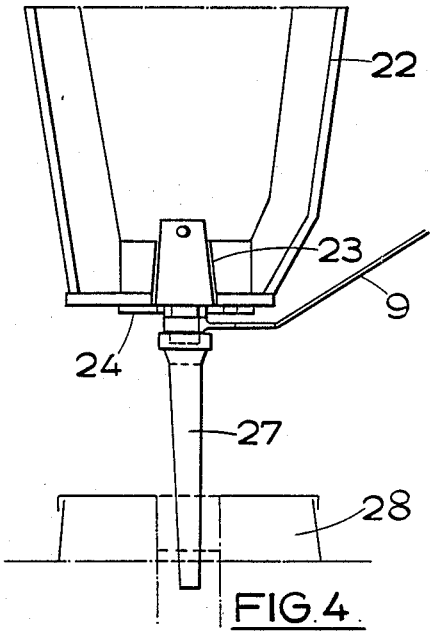
Figure 6:
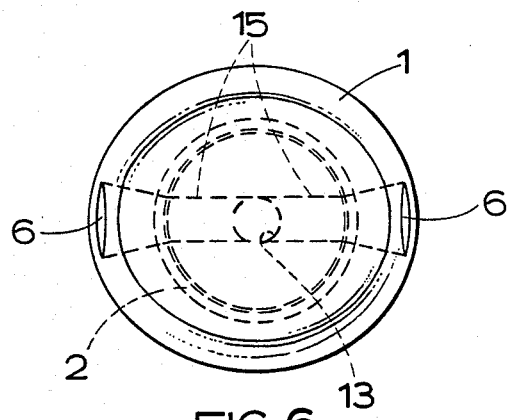
Figure 5:
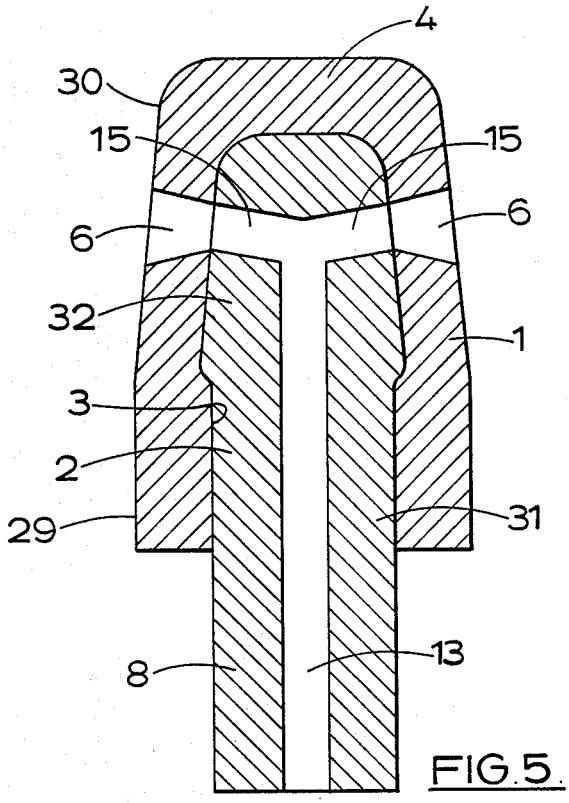
Figure 7:
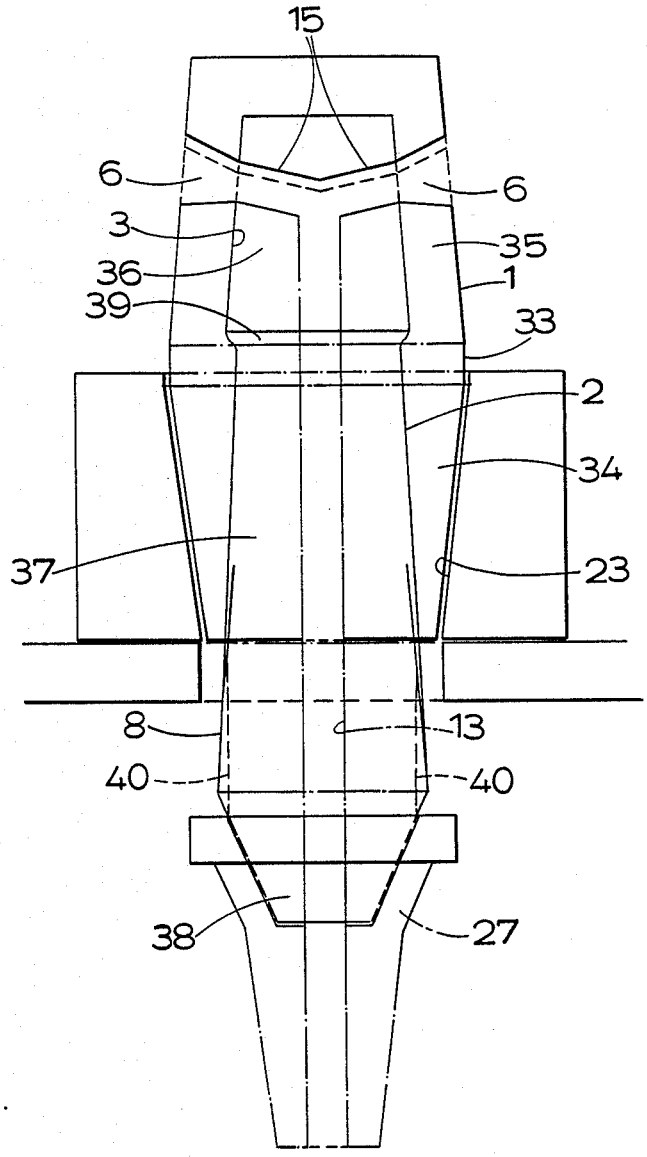

An embodiment of the invention will now be described by way of example only with reference to the accompanying drawings, in which:

FIG. 1 is a diagrammatic vertical section through a rotary pouring nozzle according to the present invention, FIG. 2 is a diagrammatic vertical section through a modified form of the pouring nozzle, FIGS. 3 and 4 show the nozzle fitted to vessels for holding molten metal, FIGS. 5 and 6 show respectively an axial section through and a plan view of a further modified form of the pouring nozzle, and FIG. 7 is a diagrammatic vertical section through yet another modified form of the pouring nozzle.

Referring to FIG. 1 of the drawings, the nozzle comprises a stationary component 1 and a rotatable component 2. Both components are made in one-piece from refractory materials. They are interlocked so that whilst the rotatable component 2 can be rotated relative to the stationary component 1 they are restrained from relative movement longitudinally and laterally of the rotational axis of the rotatable component, and are inseparable.

The stationary component 1 is of a frusto-conical shape. It has a hollow interior 3 which opens through the bottom of the component. The top 4 of the component is closed. In the tapering surface 5 of the stationary component, near the closed top 4, are two diametrically opposed flow apertures 6, of similar diameter, which extend radially into the hollow interior 3.

A major portion of the rotatable component 2 is contained within the stationary component 1. That portion is cylindrical with an enlarged diameter intermediate part 7. The interior 3 of the stationary component is shaped complementally to the portion of the rotatable component which it accommodates. There is a close fitting interconnection between the mating surfaces of the interior 3 at the rotatable component which permits rotation of the rotatable components but resists all other relative movement between the components, and also resists ingress of metal between the surfaces when the nozzle is in use. The interconnection at the enlarged intermediate part 7 of the rotatable component locks the two components together against separation. A lower end portion of the rotatable component is of square or other suitable non-circular cross-section, or is splined, to form an operating spigot 8 for engagement by a ringed end of a lever 9, FIGS. 3 and 4, for turning the component manually.

A porous inert-gas ring 10 is fitted about the enlarged intermediate part 7 of the rotatable component and is engaged in a locating annular recess 11 in the interior 3 of the stationary component. A gas feed pipe 12 extends through the refractory material of the stationary component from its bottom face to the ring 10. When the nozzle is in use inert gas, for example argon, is supplied by the gas feed pipe 12 under pressure to the ring 10 which releases the gas into the minimal gap between the interfaces of the two components so that gas-film lubrication is provided between the surfaces to prevent the rotatable component from binding or sticking in the stationary component. The gas pressure in the gap also helps to provide further resistance to ingress of metal between the interfaces.

The ring 10 may be made of a porous refractory material and be formed by a process using a sacrificial reticulated polyurethane foam impregnated with an aqueous slurry of refractory material and a binder. The impregnated foam is dried to remove water and fired to burn off the organic foam to produce a refractory foam replica. Alternatively, the ring may be a solid refractory ring which is rendered gas-permeable by drilling very fine bores to form gas conduits. A similar ring may be formed by the use of organic filaments which may be incorporated in the refractory ring during manufacture and which on subsequent heating are burnt off to leave fine interconnecting conduits.

The rotatable component has an axial bore 13 which forms a nozzle outlet and extends through the component from the bottom end face of the operating spigot 8 to an upper end part 14 of the component, above the enlarged diameter intermediate part 7, where it divides into two feeder entries 15. The feeder entries 15 extend outwardly and upwardly and open through the circumferential surface of the upper end part 14 at diametrically opposite positions at the level of the flow apertures 6 in the stationary component. The feeder entries are of similar diameters to the flow apertures with which they can be moved into and out of register by rotation of the rotatable component relative to the stationary component. The division of the axial bore 13 into the feeder entries 15 leaves the upper end of the rotatable component completely closed and solid.

An alternative arrangement of the flow apertures in the stationary component and of the feeder entries in the rotatable component is indicated by chain-dot lines in FIG. 1. Here one, running, flow aperture 6A is of smaller diameter than the other, starting, flow aperture 6, and one of the feeder entries, 15A, tapers to a diameter at its mouth, or is for its length of a reduced diameter, corresponding to that of the running flow aperture 6A. The flow apertures 6, 6A and feeder entries 15, 15A are so disposed that in one angular position of the rotatable component the starting flow aperture 6 and the feeder entry 15 of corresponding diameter are brought into register, which is a convenient mode of the nozzle for the start of pouring, and in another angular position the running flow aperture 6A and the tapering feeder entry 15A are brought into register instead for continuing the pouring.

The two components are made from castable refractory materials containing binders. Suitable binders are those including phosphoric acid and an ethyl-silicate, but other binders may be used if preferred. The components are made by the preferred method described above. Firstly the rotatable component is produced using a polystyrene, or other appropriate high definition, core to define the axial bore 13 and feeder entries 15 of the component. After establishing green strength, the refractory component is partially fired at the recognised temperature for the binders to become effective but at a temperature which is not high enough for hysteresis to occur. The core is lost by pyrolysis in the course of the partial firing. The stationary component is then cast in a conic mould around the partially fired rotatable component, after having first applied a varnish to the latter component. The ring 10 is located in the mould prior to casting of the stationary component. The varnish is applied to a uniform thickness over the whole of the surface of the interior 3 which is to mate with the rotatable component. A non-active refractory, meltable wax or similar, parting compound may alternatively be used but varnish is convenient to use. Destructable inserts, again conveniently made of polystyrene or other such material which are destructable upon firing, are provided to define the flow apertures 6 of the stationary component. Having cast the stationary component, the assembly of the two components is then fully cured and fired in the appropriate cycle of temperature and time, the temperature being higher than that at which the rotatable component had been partially fired. The rotatable component shrinks away from the stationary component in the course of this full firing. The varnish prevents the components from being bonded together during casting of the stationary component and is lost during the full firing of the assembly.

As an alternative the stationary component may be cast first using a destructable core to define its interior 3 and the flow apertures 6, and the rotatable component then cast inside it.

In the form described and shown in FIG. 1 the stationary component is a unitary casting. It may alternatively be of a composite construction. For example, as shown in FIG. 2, the stationary component may be made in two parts which connect together about the rotatable component to form the complete component. Here there is an upper part 16 formed with the flow apertures 6 and having an internally screw-threaded, co-axial, socket 17 in its bottom end, and a lower part 18 which contains the porous ring 10 and feed pipe 12 and has an axial, externally screw-threaded, spigot 19 which screws into the socket 17 and is surrounded by an annular shoulder 20 at its root. The two parts 16 and 18 together define the hollow interior 3 of the component in which the rotatable component 2 is located, its enlarged intermediate part 7 being partially accommodated in each of the two parts. In this construction the rotatable component is slightly modified in that its lower end portion is of the same circular cross-section as the rest of the component below the intermediate part 7 to aid assembly of the ring 10 and lower part 18 of the stationary component on the rotatable component.

The upper and lower parts 16, 18 are made separately from one another and from the rotatable component. In assembling the nozzle, the lower part 18, containing the porous ring 10, is first fitted on to the lower portion of the rotatable component, and then the upper part 16 is slid over the upper portion of the rotatable component and screwed on to the spigot 19 of the lower part. The spigot 19 is slightly shorter than the socket 17. Thus when the upper part is screwed fully on to the spigot a small gap remains between the spigot and the inner end of the socket and the bottom face of the upper part 16 is enabled to be seated tightly on the annular shoulder 20 of the lower part. The rotatable component is effectively locked, rotatably, in the stationary component in its operative relationship with that component.

A collar may be fitted to the lower end portion of the rotatable component, below the lower part of the stationary component, for engagement by a lever, or other suitable implement, for turning the rotatable component manually relative to the stationary component.

As an example only, a refractory material from which either one or both of the components may be made, in the embodiment of FIG. 1 or the modification of FIG. 2, is a graphitised alumina composition. Typically the composition comprises by weight, 30–60% alumina and 5–30% graphite. This material is known for use in connection with steel and other molten metals.

One or both of the components described may be made in other ways, as by moulding or a process of isostatic or high pressure linear pressing.

In the embodiment and modification described the spigot 8, or the collar, may be adapted for turning the rotatable component by power-driven means, if required. For example, the spigot or collar may be connected for turning by a hydraulically-operated piston, or there may be a mechanical drive such as a rack and pinion in which the spigot is engaged with, or the collar may be, the pinion.

For use the nozzle is mounted in the bottom of a vessel which is to hold molten metal for pouring. The vessel may, for example, be a foundry type ladle 21 as shown in FIG. 3, or a tundish 22 as shown in FIG. 4 for use in billet or bloom casting. For each of these applications the stationary component of the nozzle is engaged and sealed in a complementary frusto-conical opening 23 in the bottom of the vessel, and is secured by a retaining ring 24 held fast to the underside of the exterior of the vessel by pegs 25 fixed to the vessel and wedges 26. As installed, the upper end of the stationary component projects into the vessel to an extent such that the flow apertures 6 are above the level of the lining of the vessel.

The stationary component may be readily disconnected from the vessel for repair or replacement of the nozzle.

The lever 9 for turning the rotatable component is applied to the component below the retaining ring 24. By means of the lever 9 the rotatable component can be turned relative to the stationary component between a pouring position in which the feeder entries 15 are in register with the flow apertures 6 and metal can flow out of the vessel through the nozzle outlet bore 13, and a closed position in which the feeder entries are out of register with the flow apertures. Upon being turned to the closed position, all residual metal in the feeder entries and nozzle outlet of the rotatable component drain out of the nozzle. Thus the nozzle is self-draining which is particularly advantageous because there is no problem of metal solidifying in the nozzle, and hence the periods for which the nozzle can be left closed between pourings are not limited. Pouring will commence immediately upon turning the rotatable component to the pouring position.

As shown in FIG. 4 a submerged entry shroud 27 may be fitted to the rotatable component, for example, for feeding metal into a billet or bloom mould 28 or for shielded casting of steel in a continuous casting process. The submerged entry shroud 27 rotates with the rotatable component. It may be straight, as shown, or bifurcated.

Two further modified forms of the rotary pouring nozzle are illustrated by FIGS. 5, 6 and 7 of the accompanying drawings and will now be described. Parts corresponding to those of the embodiment described are identified by the same reference numerals. In each of these modified forms the stationary component 1 and the rotatable component 2 are each made in one piece of refractory material. They may be made by the method described above.

A particular feature of the modified form of the nozzle illustrated by FIGS. 5 and 6 is that the stationary component 1 has an oval external circumferential shape. For mounting the nozzle for use the stationary component is located and sealed in an opening of complementary oval shape in the bottom of the vessel to which the nozzle is fitted. Thus the interengagement between the stationary component and the opening prevents rotation of the stationary component with the rotatable component relative to the vessel.

In this modified form of the nozzle a lower portion 29 of the stationary component is of a constant cross-section, and an upper portion 30 of the component containing the flow apertures 6 tapers upwardly and merges into the closed top 4 of the component at a well-rounded radius. There are two diametrically opposed flow apertures 6, which have an outward flare. The rotatable component 2 has a cylindrical stem portion 31 and an enlarged, upwardly tapering, head portion 32 accommodated in the complementally shaped interior 3 of the stationary component. The taper of the head portion 32 similarly merges into the top of the head portion at a well-rounded radius. As before, the close fitting interconnection between the mating surfaces of the interior 3 of the stationary component at the stem and head portion of the rotatable component permits rotation of the rotatable component in the stationary component but resists other relative movement between the components. The nozzle outlet in the rotatable component is again formed by an axial bore 13 from the upper end of which two oppositely directed feeder entries 15, of similar diameter of the inner ends of the flow apertures 6, extend outwardly and slightly upwardly to the tapering circumferential surface of the head portion 32 at the level of the inner ends of the flow apertures. A lower part of the stem portion 31 projects out of the bottom of the stationary component to form the operating spigot 8 of the rotatable component, which may be splined or otherwise suitably formed for engagement by a ringed end of a lever or by power-driven means.

The stationary component 1 of the further modified form of the nozzle illustrated by FIG. 7 is of a double frusto-conical external shape tapering towards its opposite ends from a short cylindrical central portion 33. A lower frusto-conical portion 34 locates in and is sealed in an opening 23 of complementary shape in the bottom of the vessel to which the nozzle is fitted for use. The location is made from inside the vessel, which is convenient when the vessel is a tundish or small ladle. An upper frusto-conical portion 35 contains the flow apertures 6 of which again there are two, being diametrically opposed and outwardly flared. In this modification the rotatable component 2 has an upwardly tapering head portion 36 within the upper frusto-conical portion 34 of the stationary component, and a stem portion 37 which for the greater part of its length from the head portion flares downwardly and terminates in a downwardly tapering frusto-conical lower end 38 spaced below the bottom of the stationary component. Adjacent the stem portion 37 the head portion 36 has a narrow bevelled annular undersurface 39. The interior 3 of the stationary component is shaped complementally to the head portion 36, the bevelled undersurface 39 and the adjoining part of the stem portion 37 of the rotatable component to permit rotation of the latter but no other relative movement between the two components. The nozzle outlet in the rotatable component is formed, as before, by an axial bore 13 extending down from the head portion, through the stem portion and the lower end 38 and having two oppositely directed feeder entries 15, of similar diameter to the inner ends of the flow apertures 6, extending to the tapering circumferential surface of the head portion at the level of the flow apertures. That part of the stem portion 37 projecting below the stationary component forms the spigot 8 of the rotatable component for turning the component. At the spigot 8, in the region where the flared part of the stem portion 37 and the frusto-conical lower end 38 meet, splines 40 are formed for engagement by a ringed end of a lever or by power-driven means.

As shown in FIG. 7, the lower end 38 of the stem portion 37 of the rotatable component can co-operate with a submerged entry shroud 27.

Although the lower and upper externally tapering portions 34 and 35 of the stationary component have been described as frusto-conical it will be understood that at least the lower portion may also be of tapering oval, or other non-circular, external circumferential shape for engagement with an opening of complementary shape in the bottom of the vessel to which the nozzle is fitted for use.

The stationary and rotatable components may be interlocked in other ways from those described and illustrated. One or the other may be formed with an annular groove or recess with which a keying projection or projections on the other engage to allow the rotatable component to rotate in the stationary component and yet restrain other relative movement between the components. For example, an annular groove may be formed in the circumference of the rotatable component, and angularly spaced orifices may be formed in the stationary component opposite the groove into which a castable refractory is injected to enter into the groove and be fixed to the stationary component in the orifices, thereby locking the rotatable component in the stationary component. Prior to injecting the castable refractory the groove is coated with varnish or other suitable parting agent to prevent the refractory from bonding to the rotatable component. Another possibility is to form a groove in the circumference of the rotatable components and locate pre-formed segments, which may be made of refractory, in an adjacent recess or recesses in the stationary component to project into the groove. The segments may be urged into the groove by spring loading, for example provided by helical compression springs held against outer circumferential surfaces of the segments in the recess or recesses by a circumferential band or annulus fitted around the stationary component opposite the recess or recesses.

We claim:

1. A rotary pouring nozzle for a vessel for holding molten metal, comprising a stationary component and a rotatable component sealingly engaged rotatably in said stationary component for rotation relative to said stationary component about a rotational axis fixed with respect to said stationary component, said stationary and rotatable components having interlocking parts inside said stationary component which retain said components together in their working relationships, said stationary component having a flow aperture directed laterally of said rotational axis, and said rotatable component having a nozzle outlet movable into and out of communicating register with said flow aperture by rotation of said rotatable component relative to said stationary component.

2. A rotary pouring nozzle according to claim 1 in which said interlocking parts comprise a recess in one of said components and a projection in the other of said components engaged in said recess.

3. A rotary pouring nozzle according to claim 1 in which said rotatable component has an enlarged portion, and said stationary component has an internal complementary recess in which said enlarged portion is trapped, said enlarged portion and said recess constituting said interlocking parts.

4. A rotary pouring nozzle according to claim 1 in which said stationary component has a non-circular external circumferential shape for locating engagement in a complementary non-circular opening in a vessel.

5. A rotary pouring nozzle according to claim 1 in which said stationary component has a part of tapering external circumferential shape engagement in a complimentary opening in a vessel.

6. A rotary pouring nozzle according to claim 1 in which said stationary and rotatable components each have a unitary structure.

7. A rotary pouring nozzle according to claim 1 in which said stationary component is of a composite construction comprising separately made parts secured together about said rotatable component.

8. A rotary pouring nozzle according to claim 1 in which said stationary component has a plurality of flow apertures angularly spaced about said rotational axis, and said rotatable component is rotatable to move said nozzle outlet selectively into communicating register with any one of said flow apertures.

9. A rotary pouring nozzle according to claim 8 in which said flow apertures are of differing cross-sectional sizes.

10. A rotary pouring nozzle according to claim 1 in which said nozzle outlet has a plurality of feeder entries in said rotatable component of differing cross-sectional sizes selectively registrable with said flow aperture by rotation of said rotatable component relative to said stationary component.

11. A rotary pouring nozzle according to claim 1 in which a gas-permeable ring is located in said stationary component about said rotatable component having means for connection of said ring to gas supply means to provide gas-film lubrication between said components.

12. A rotary pouring nozzle according to claim 1 in which said rotatable component has a spigot part projecting out of said stationary component of non-circular external circumferential shape for annular engagement by drive means for rotating said rotatable engagement.

13. A vessel for holding molten metal having a rotary pouring nozzle which comprises a stationary component fixed to the vessel against movement relative thereto and a rotatable component sealingly engaged rotatably in said stationary component for rotation relative to said stationary component about a rotational axis fixed with respect to said stationary component, said stationary and rotatable components having interlocking parts inside said stationary component which retain said components together in their working relationship, said stationary component having a flow aperture directed laterally of said rotational axis, and said rotatable component having a nozzle outlet movable into and out of communicating register with said flow aperture by rotation of said rotatable component relative to said stationary component.

* * * * *